United States Patent [19]

Albert

[11] Patent Number: 4,571,745

[45] Date of Patent: Feb. 25, 1986

[54] MULTI-PLY GARMENT COMPONENT AND METHOD OF FABRICATION

[76] Inventor: Michael P. Albert, 32 Kelveden Rd., Newton, Mass. 02168

[21] Appl. No.: 613,689

[22] Filed: May 24, 1984

[51] Int. Cl.[4] ..... A41B 3/00

[52] U.S. Cl. ..... 2/139; 2/143

[58] Field of Search ..... 2/139, 76, 98, 122, 2/123, 127, 131, 132, 134, 143, 146, 243 R, 243 B, 247, 255, 272

[56] References Cited

U.S. PATENT DOCUMENTS

| | | | |
|---|---|---|---|
| 2,105,668 | 1/1938 | Lyons | 2/143 X |
| 2,674,741 | 4/1954 | Donaldson | 2/143 X |
| 3,333,280 | 8/1967 | Hynek et al. | 2/143 |
| 3,621,491 | 11/1971 | Hall et al. | 2/131 |
| 3,953,894 | 5/1976 | Aron | 2/146 |
| 4,040,125 | 8/1977 | Blue | 2/139 |

*Primary Examiner*—Werner H. Schroeder
*Assistant Examiner*—J. L. K. Olds
*Attorney, Agent, or Firm*—Blum, Kaplan, Friedman, Silberman & Beran

[57] ABSTRACT

A multi-ply garment component formed of two creased outer plies of fabric having a thermoplastic resin deposited on the inner surfaces and an improved method of fabricating the component are provided. The edges of the fabric with resin are folded in over an interlining piece having a dimension corresponding substantially to the final component and subjected to heat and pressure to fuse the fabric to the shape of the component. A complimentary creased fabric/interlining intermediate or creased fabric is placed in back-to-back alignment and edge stitched along the folded edges to form the component.

15 Claims, 10 Drawing Figures

MULTI-PLY GARMENT COMPONENT AND METHOD OF FABRICATION

BACKGROUND OF THE INVENTION

This invention relates to a multi-ply garment component and a method of fabrication, and more particularly to garment components including at least one fabric interlining layer between two outer fabric plies and their methods of fabrication.

Various types of garment components require a fabric interlining between two plies of fabric in order to impart additional support strength, stability, stiffness and/or body to the component. For example, shirt collars, neckbands, cuffs, epaulets, pocket flaps and various types of waistbands, belts and tabs generally are fabricated with two outer fabric plies sewn together and at least one interlining ply. Such multi-ply garment components may be fabricated by stitch-and-turn sewing operations or crease-banding operations.

In conventional crease-banding operations, garment components such as neckbands are formed from two complimentary bands each containing an outer fabric ply fused to an interlining having an adhesive coated on both sides. When the neckband is fabricated, the outer fabric and interlining are folded over and subjected to heat and pressure in order to prefold and fuse the neckband intermediates. When the crease-banded neckbands are assembled with a collar of three plies, the stitched portions of the shirt neck at the junction of the neckband and collar includes 11 plies of cloth as shown in the cross-section of FIG. 1. Crease-banded collars, neckbands and shirt cuffs and methods of fabrication are described in U.S. Pat. No. 3,333,280.

Interlinings are required in these multi-ply garment components, as the fabric itself does not have sufficient structural integrity to support the components such as a cuff or, in the case of a neckband, to support the weight of a collar. It is not practical to use a heavier interlining than used in conventional crease-banding as described above. Two heavier interlinings would add bulk at the seams. It has also been suggested to use a heavier interlining on the inside or stamped neckband and a light interlining on the corresponding outside band. This solution results in inventory and handling problems as the complimentary neckband pieces are not functionally interchangeable with respect to the crease-banding heavy and light interlinings used.

Conventional crease-banding utilizing an interlining having adhesive on both surfaces also has shortcommings. Firstly, the interlining must be coated with adhesive on both surfaces and there are limited types of such interlining available commercially. It is not possible to fabricate a crease-banded component utilizing a 250 Denier 100% polyester interlining for wash and wear applications. A 100% polyester interlining, even when coated with a heat sensitive adhesive on both surfaces is too resilient to hold the crease to be utilized in conventional crease-banding operations.

Accordingly, it is desirable to provide an improved multiply garment component including an interlining ply and improved methods for their fabrication which overcome the above-noted problems associated with conventional crease-banding operations.

SUMMARY OF THE INVENTION

Generally speaking, in accordance with the invention, a multi-ply garment component intermediate including an outer ply of fabric with its edges folded over an interlining and a multi-ply garment component formed of two outer plies of fabric and at least one ply of interlining is provided. Improved methods of fabricating the intermediate and multi-ply component by depositing a thermoplastic resin on the interior surface of the outer fabric plies are also provided. The garment component may be a shirt collar, neckband, cuff, epaulet, pocket flap and the like. The resin may be a permanent thermoplastic resin or one which is removed when the garment is laundered or cleaned.

Component intermediates in accordance with the invention are formed by depositing a thermoplastic resin on the back surface of an outer fabric ply, placing a cut interlining ply on the outer fabric ply and folding the edges of the outer fabric about the interlining and subjecting the fabric and interlining to heat and pressure to fuse the folded fabric edges to the interlining. Both folding and fusing operations may be performed by using conventional crease-banding machinery.

A finished multi-ply component is assembed by placing one fabric and interlining intermediate in alignment with another such intermediate or a creased fabric piece and edge-stitching the pieces. This permits fabrication of a garment component by crease banding utilizing an interlining which does not have a thermoplastic resin coating on the interlining.

Accordingly, it is an object of the invention to provide an improved multi-ply garment component.

It is another object of the invention to provide an improved method of fabricating a multi-ply garment component including two outer plies of fabric and at least one fabric interlining.

It is a further object of the invention to provide an improved multi-ply garment component formed from an interlining without adhesive.

Still another object of the invention is to provide an improved creased component intermediate.

Still another object of the invention is to provide an improved multi-ply garment component utilizing substantially less interlining than in conventional crease-banding type operations.

Still a further object of the invention is to provide an improved method for forming creased garment components utilizing interlining which does not have a thermoplastic coat on its surfaces.

Yet another object of the invention is to provide an improved multi-ply garment component including an interlining ply wherein the interlining is cut to substantially the size of the final shape of the component.

Yet a further object of the invention is to provide an improved method for fabricating multi-ply garment components wherein the inner surfaces of the outer fabric plies are coated with thermoplastic resin and fused to an interlining ply cut to reduce the thickness of the final component substantially.

Still other objects and advantages of the invention will in part be obvious and will in part be apparent from the specification.

The invention accordingly comprises the articles possessing the features, properties and the relation of elements and the several steps and the relation of one or more of such steps with respect to each other, which are exemplified in the detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
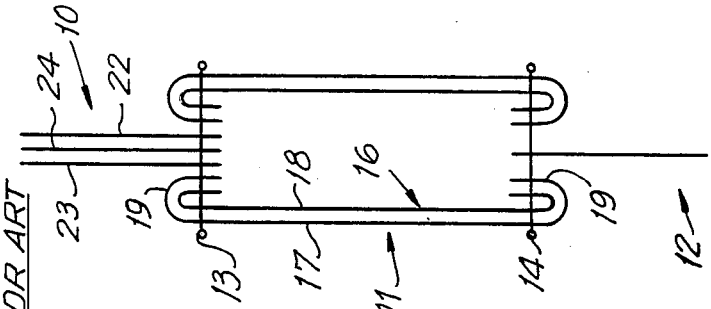
FIG. 1 PRIOR ART
FIG. 1 is a cross-sectional drawing of a shirt collar and neckband assembly constructed and arranged in accordance with conventional crease-banding operations.

FIG. 1 illustrates a cross-sectional drawing of a shirt collar and neckband assembly constructed and arranged in accordance with conventional crease-banding techniques. The assembly includes a collar portion 10 sewn into a neckband 11 and a shirt body 12 sewn into the bottom side of neckband 11. Collar 10 is stitched to neckband 11 by a stitching operation 13 and shirt body 12 is sewn to neckband 11 by a stitching operation 14. Utilizing crease-banded neckband components eliminates the several stitching operations associated in the widely used "run and turn" sewing operations.

The crease-banding operation will be described with respect to the neckband where it finds the greatest use today. Of course, the crease-banding technique is applicable to a wide variety of garment components as will be described in more detail below. Conventional crease-banding operations utilize an interlining having a thermoplastic resin on both surfaces of the interlining.

A neckband 11 is formed by first forming a crease-banded intermediate 16 which includes an outer fabric 17 and an inner interlining ply 18 both cut to the same dimension. Interlining 18 has the thermoplastic resin deposited on both surfaces so that when a composite including fabric ply 17 and interlining 18 is placed in a crease-banding machine, edges 19 are folded in and are held in place by application of heat and pressure to fuse the thermoplastic resin on the surfaces of interlining 18 to fabric 17. Neckband 11 is formed by placing complimentary neckband and neckband interliner intermediate 16 in face-to-face relation. Collar 10 is inserted at the top end and shirt body 12 is inserted at the bottom end and stitching operations 13 and 14 are performed to form the finished assembly. In the drawing, collar 10 includes a bottom collar fabric 22, a top collar fabric 23 and a collar interlining 24. This construction results in 11 plies at stitching operation 13. It is this bulk created at the stitch line which is eliminated by the construction in accordance with the invention.

Figure 2:
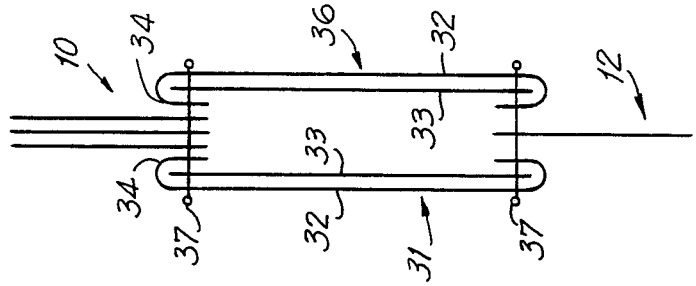
FIG. 2 is a cross-sectional drawing of a comparable shirt collar and neckband assembly constructed and arranged in accordance with the invention.

FIG. 2 is a cross-sectional drawing of an embodiment of a collar and neckband assembly constructed and arranged in accordance with one embodiment of the invention wherein both neckband intermediate portions include an interlining. Specifically, the collar and neckband assembly of FIG. 2 includes a collar 10 having the same construction as collar 10 of FIG. 1 joined to the top portion of a neckband assembly 31 and shirt body 12 joined to the bottom of neckband assembly 31. The top of neckband assembly 31 includes an outer fabric ply 32 having the same dimension as fabric 17 of neckband 11 of FIG. 1. However, neckband interlining 33 is dimensioned only to the dimension of the finished neckband and not the same dimension as the outer fabric 32. In this embodiment, a thermoplastic resin is deposited on the inner surface of fabric ply 32 and the edges 34 of fabric ply 32 are folded over onto interlining 33 and fused by application of heat and pressure. This fusing may take place in a conventional crease-banding machine. A complimentary outside neckband intermediate 36 may be formed in the same manner. The garment is assembled utilizing the stitching operation 37 to secure collar 10 at the top of neckband 31 and a second stitching operation 38 to secure shirt body 12 to the bottom of neckband assembly 31. This final assembly is performed in the same manner as that of FIG. 1.

The advantages attained in accordance with the construction illustrated in FIG. 2 are as follows. The number of plies at stitch line 37 is only 9 compared to 11 in the construction of FIG. 1. Additionally, approximately 30% less interlining is used in the construction of FIG. 2 as the interlining is not folded over itself, and positioned in the center of cut fabric pieces 32. Further, interlining 33 may be of any type of interlining desired and is not coated with thermoplastic resin. This resin is deposited only on the inner surface of outer fabric plies 32.

Figure 3:
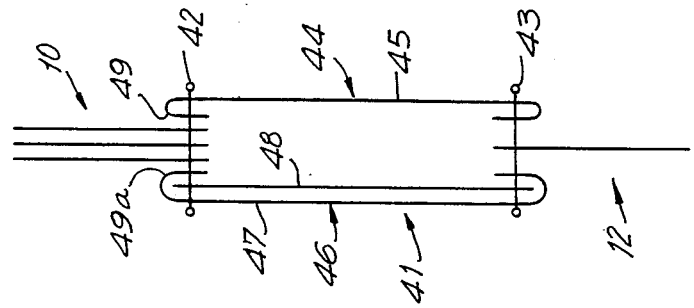
FIG. 3 is a cross-sectional drawing of a shirt collar and neckband assembly constructed and arranged in accordance with another embodiment of the invention.

The ability to use a wide variety of fabric interlining without adhesive deposited thereon permits fabrication of a collar and neckband assembly including one less ply of fabric as illustrated in cross-sectional drawing of FIG. 3. In this construction, collar 10 and shirt body 12 are stitched into the top and bottom of neckband assembly 41 at stitch line 42 and 43 respectively. At stitch line 42 there are only 8 plies of fabric.

Neckband assembly 41 includes neckband component 44 formed of only fabric ply 45 having a thermoplastic resin deposited on the interior surface. When the edges of fabric ply 45 are folded over and heat and pressure are applied, folded edges 49 are held in the creased position by the fusing of the resin. Outside neckband intermediate 46 includes an outer fabric ply 47 and an interlining ply 48 and is creased to form fold **49*a* as described in connection with the assembly of FIG. 2. In the construction of FIG. 3 interlining 48 may be of a heavy weight than interlining 33 in the construction illustrated in FIG. 2**. This results in a structure needing only one interlining for structure stability and thus a further saving of interlining.

Figure 4:
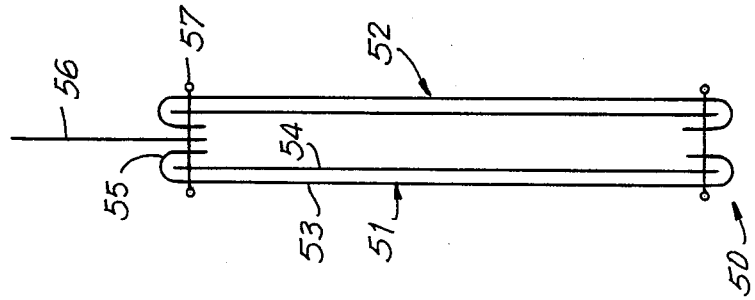
FIG. 4 is a cross-sectional drawing of a shirt cuff constructed and arranged in accordance with the invention.

Referring now to FIG. 4, a cross-sectional drawing of a shirt cuff 50 formed in accordance with the invention is shown. Cuff 50 includes a top cuff intermediate 51 and a bottom cuff intermediate 52. Each cuff intermediate is formed of an outer fabric ply 53 and an interlining ply 54, with interlining ply 54 cut substantially to the final dimension of the cuff. After an edge 55 about the perimeter of fabric ply 53 is folded about interlining 54, a shirt sleeve 56 is inserted between the upper edges of facing intermediates 51 and 52 and stitched along a stitch line 57 about the perimeter for joining the cuff to sleeve body 56 at the top of cuff 50. Alternatively, a shirt cuff may be formed utilizing an intermediate of an outer cuff fabric and interlining and a second creased outer fabric ply as in the construction of neckband 41 shown in FIG. 3.

Figure 5:
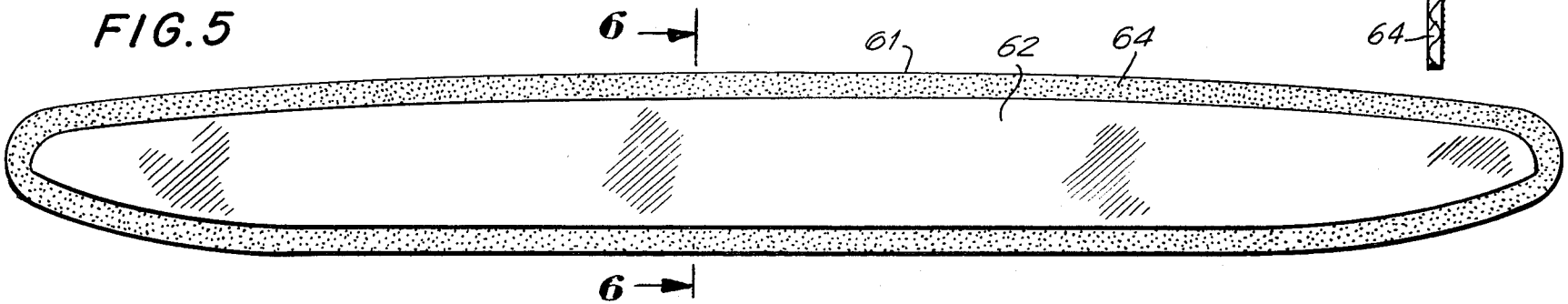
FIG. 5 is a plan view of a cut interlining piece substantially in the shape of the final component centered on a outer ply fabric.
Figure 7:
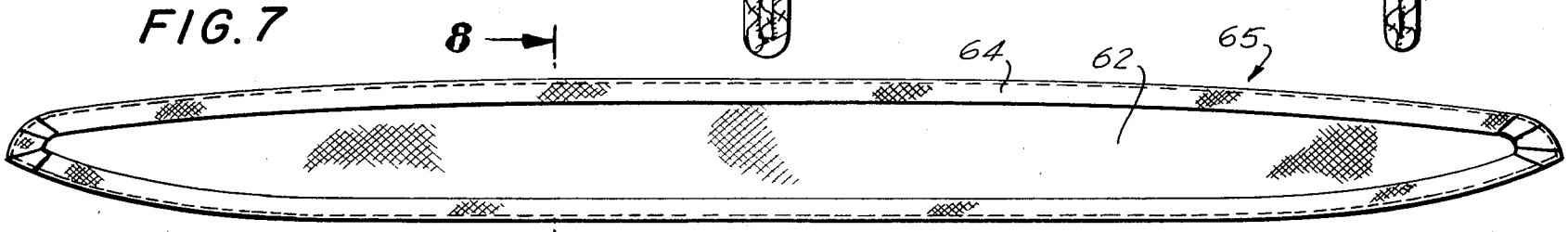
FIG. 7 is a plan view of the interlining and outer fabric ply of FIG. 5 which has been folded and fused to form a neckband intermediate.

Referring now to FIG. 5, a plan view of a cut neckband fabric 61 and a cut interlining ply 62 are shown with interlining 62 centrally positioned on fabric 61. Cut fabric 61 is cut in a dimension greater than the final dimension of a neckband to be formed as it includes sufficient fabric to be folded in on itself to present finished edges for assembly of the shirt neckband. Edge 64 of cut fabric 61 is cut approximately ¼ inch greater than neckband interlining 62 which is cut to substantially the dimension of a finished neckband intermediate shown as 65 in FIG. 7. The inner surface of cut fabric 61 facing interlining 62 has been coated with a surface coating of a thermoplastic resin so that intermediate 65 having folded edge 64 may be formed in a crease-banding machine upon application of heat and pressure.

Figure 6:
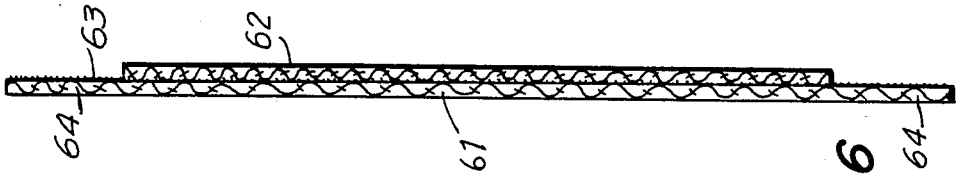
FIG. 6 is a cross-sectional view of the assembly of FIG. 5 taken along line 6—6.
Figure 8:
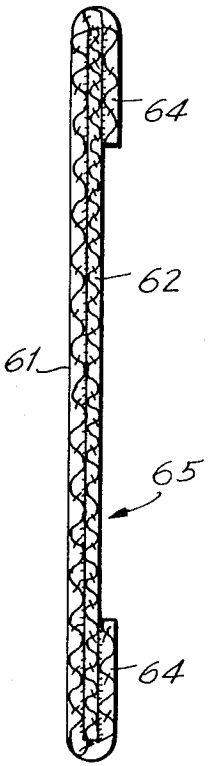
FIG. 8 is a cross-sectional view of the neckband intermediate of FIG. 7 taken along line 8—8.

A cross-section of cut fabric 61 and interlining 62 with adhesive 63 on the surface of fabric 61 facing interlining 62 is shown in FIG. 6. The fabric pieces in this configuration or position are placed in a crease-banding machine and edge 64 of fabric 61 extending beyond interlining 62 is folded about interlining 62 as shown in the plan view of FIG. 7. Assembled neckband intermediate 65 is shown in cross-section in FIG. 8. As resin is deposited along the entire inner surface of outer fabric 61, edge 64 is firmly held against and overlapped on interlining 62 after application of heat and pressure.

Figure 10:
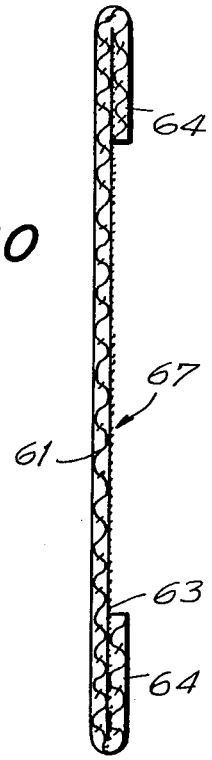
FIG. 10. is a cross-sectional view of the neckband intermediate of FIG. 9 taken along line 10—10.
Figure 9:
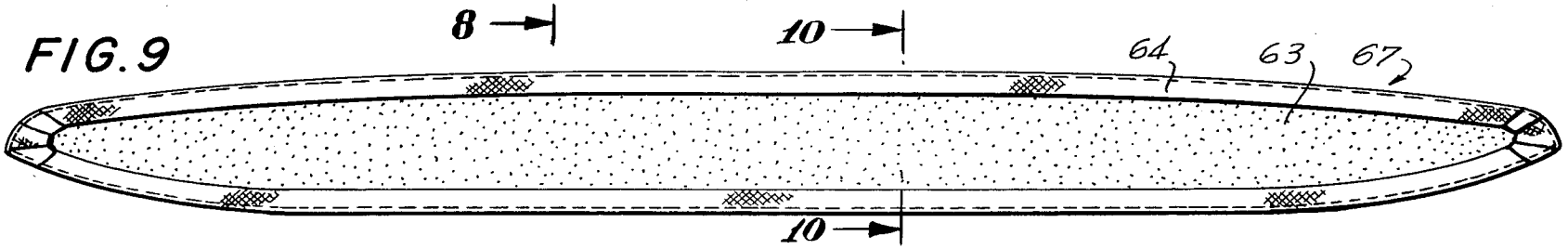
FIG. 9 is a plan view of a creased and fused neckband intermediate formed of only an outer fabric ply.

As resin is deposited on the inner surface of fabric 61, a creased garment component intermediate may be formed without the need for an interlining ply. As shown in FIG. 9, and in the cross-section in FIG. 10, a creased neckband intermediate without interlining may be formed. Such a creased outer ply fabric 67 as shown in FIGS. 9 and 10 may be utilized as an outer band portion 44 of neckband assembly 41 as shown in FIG. 3. In this construction one intermediate eliminates the interlining ply. As thermoplastic resin 63 is deposited directly on the back side of the outer fabric ply inventory problems associated with storing interlinings of varying weights and qualities does not present itself. When fabricating a shirt having a neckband assembly 41 as shown in FIG. 3, outside neckband intermediate 67 of FIG. 9 would be aligned with a inside (stamped) neckband intermediate 46 as shown in FIG. 3 for forming the finished collar and neckband assembly of the garment.

The thermoplastic resins preferably fuse at temperatures ranging from about 150° F. to about 372° F. and pressures between about 40 to 70 pounds per square inch. Fusing times vary between about 0.5 to 2 seconds. The resin may be a permanent fusible resin or may be a resin suitable to provide temporary bonding. Those providing temporary bonding are the type of resins utilized in commercially available interlinings utilized in crease-banding operations. Such interlinings are available from The Harodite Finishing Company, Inc., Staflex Company and Facemate Corporation. The thermoplastic resins designed to provide temporary bonding are removed from the garment when the garment is washed or cleaned. The permanent resins are retained in the component after washing and cleaning of the finished garment. Any thermoplastic resin having the desired properties are suitable. Such resins include polyvinyl acetates, polyvinyl alcohols, polyvinyl chlorides, polyacrylate resins, polyamide resins, polyester resins, polyethylene resins and the like.

When preparing garment components in accordance with the invention, the plies are cut to the required dimension. As noted above, the shell fabric plies are cut to a larger size than the finished component in order to provide material to be folded over in the creasing operation. The cut fabric plies or full width cloth are placed in a coating machine and a thermoplastic resin of the type described above is applied by various coating methods—wet or dry, scattered or printed.

In one method, generally, the thermoplastic resin is ground to about 25 to 50 mesh, preferably 35 mesh. Additives, such as calcium stearate and paraffin wax may be added in amounts of about 1% in order to prevent blocking. The resin is sprinkled onto the cut fabric pieces on a screen. Any resin not adhering to the fabric falls through the screen and may be reutilized. In order to adhere the resin to the fabric, the sprinkled fabric is passed through an oven maintained at temperatures between about 300° to 400° F. for between from about 3 seconds to 1 minute. In a continuous operation, the coated fabric may be passed through an oven maintained at about 350° F. at speeds ranging from about 40 to 60 yards per minute.

In the case of permanent resins, a polyvinyl acetate polymer of higher molecular weight or a coploymer having less tendency to be water sensitive is utilized. If a higher melting resin is used, a plastizer may be added to lower the fusing the temperature of the resin.

The following examples are set forth in order to illustarte the garment components and methods of fabrication in accordance with the invention. The examples are set forth for purposes of illustration only, and not intended in a limiting sense.

EXAMPLE 1

A polyvinyl acetate resin designated ASB 516 obtained from Air Products and Chemicals of Allentown, Pa. was ground to 35 mesh. The ASB 516 is a polyvinyl acetate modified to be base sensitive. About 1% calcium sterate and about 1% paraffin wax are added to the ground polyvinyl acetate resin.

A series of cut neckbands outer fabric plies were placed on a screen and the resin was scatter coated onto the fabric at 0.25 ounces per square yard. The sprinkled cut fabric pieces were placed in an oven maintained at 320° F. for about 30 seconds, sufficient to adhere the resin to the fabric. These coated neckband fabric pieces were ready for assembly into a neckband intermediate.

EXAMPLE 2

A conventional neckband interlining fabric was cut to substantially the dimension of a shirt neckband. A neckband intermediate was prepared by placing a cut interlining piece in the center of a cut fabric piece prepared in Example 1. The coated outer fabric and interlining were placed into the die of an automatic creasing machine and the edges of the outer fabric were folded over the interlining and fused. The fusing was accomplished at a machine setting of 350° F. for 0.5 second at a pressure of about 55 pounds per square inch. The adhesion between the creased edge of the outer fabric and the interlining was excellent.

EXAMPLE 3

A creased shirt neckband fabric was prepared by taking a coated fabric prepared in Example 1 and creasing the edges without interlining. A shirt collar and neckband assembly was then prepared by utilizing the creased fabric as the outside band and the fabric and interlining intermediate as the corresponding stamped band portion. The two band intermediates were placed back-to-back and a finished shirt collar was inserted along the top of the assembled neckband. A hemline was then stitched along the top surface of the band through the stamped neckband intermediate, the collar assembly and the creased bottom band fabric to provide the construction shown in FIG. 3. The finished assembly had good appearance and hand. During the first laundering of the assembly, the temporary thermoplastic resin was removed from the shirt fabric.

By fabricating garment components having the thermoplastic resin applied directly to the inner surfaces of the outer fabric plies in contrast to utilizing conventional two-sided resin coated interlinings provides several advantages. Firstly, coating the fabric permits use of any type of interlining material as one is not limited to using an interlining having a thermoplastic coating on both surfaces thereof. Secondly, less interlining is used compared to conventional crease-banding operations wherein the interlining is utilized in both complimentary intermediates and is cut to the full dimension of the outer fabric plies. Additionally, interlining need not be used in both neckband intermediate components of a collar, neckband or cuff as a heavier weight interlining may be used only on one side since the edges of the interlining are not turned. It is estimated that about 30% less interlining is utilized in accordance with the invention by not folding over the edges. Accordingly, when only one component intermediate includes the interlining, a savings of 65% of the amount of interlining utilized today in crease-banding operations would be effected in accordance with the invention. Further, as noted earlier, the method of fabrication in accordance with the invention permits utilizing 250 denier 100% polyester interlinings for providing improved wash and wear properties in the finished garments.

It will thus be seen that the objects set forth above, among those made apparent from the preceding description, are efficiently attained and, since certain changes may be made in carrying out the above process and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A multi-ply garment component comprising at least two outer fabric plies, each outer fabric ply having a heat fusible resin deposited on the inner surface thereof and the edges of each outer fabric ply folded over and fused to form a fused outer fabric ply, each fused fabric ply having a dimension substantially that of the component;

at least one of the outer fabric plies including a cut fabric interlining having a dimension corresponding substantially to the component and smaller than the outer fabric ply, the cut interlining placed onto the outer fabric ply and the edges of the outer fabric ply which extend beyond the interlining folded over the interlining and fused substantially along the region of the folded over fabric ply by the application of heat and pressure to form a creased fabric/interlining intermediate; and the fused fabric plies with folded edges placed in alignment with the inner surfaces facing each other and switched along the folded edges to form the garment component.

2. The multi-ply garment component of claim 1, wherein each fused outer fabric ply includes a cut fabric interlining having a dimension corresponding substantially to the component and smaller than the outer fabric ply, the cut interlining placed onto the outer fabric ply and the edges of the outer fabric ply which extend beyond the interlining folded over the interlining and fused by the application of heat and pressure to form a creased fabric/interlining intermediate and said fabric-/interlining intermediates stitched to each other to form the component.

3. The multi-ply garment component of claim 1, wherein the heat-fusible resin is a permanent resin.

4. The multi-ply garment component of claim 1, wherein the heat-fusible resin is a temporary resin which is removed from the fabric plies after the component is laundered or cleaned.

5. The multi-ply garment component of claim 1, wherein the heat-fusible resin is a polyvinyl acetate resin modified to be removed from the fabric in alkaline laundering conditions.

6. A multi-ply garment component, comprising:

a first fabric/interlining intermediate formed of a first outer fabric ply having a dimension larger than the component with a heat-fusible resin deposited on the inner surface thereof and a cut fabric interlining having a dimension corresponding substantially to the component and smaller than the outer fabric ply, the interlining placed onto the outer fabric ply with the edges of the outer fabric ply extending beyond the interlining, the edges folded about the interlining and fused along the folded edges of the outer fabric by application of heat and pressure;

a complimentary creased outer fabric ply corresponding in dimension to the first outer fabric ply formed with a heat fusible resin deposited on the inner surface thereof and the edges folded over to the dimension of the component and maintained in the folded condition by fusing of the resin due to the application of heat and pressure; and the first outer fabric/interlining intermediate and complimentary fabric ply placed in alignment with the inner surfaces facing each other and stitched along the creased edges to form the garment component.

7. The multi-ply garment component of claim 6, wherein the heat fusible resin is a polyvinyl acetate resin modified to be removed from the fabric in alkaline laundering conditions.

8. A garment intermediate for forming a multi-ply garment component comprising an outer fabric ply having a dimension larger than the component with a heat fusible resin deposited on one surface, an interlining cut smaller than the outer fabric ply and substantially the dimension of the component placed onto the surface of the cut fabric ply having the resin and the edges of the fabric ply folded over onto the interlining and fused substantially along the region of the folded outer fabric ply by application of heat and pressure.

9. The multi-ply garment component of claim 8, wherein the heat fusible resin is a polyvinyl acetate resin modified to be removed from the fabric in alkaline laundering conditions.

10. A method of fabricating a multi-ply garment component, comprising:

obtaining a first outer fabric ply having a shape corresponding to the garment component and a dimension larger than the garment component;

coating and fixing a thermoplastic resin on one surface thereof;

obtaining a cut fabric interlining having a dimension substantially corresponding in shape and size to the component and smaller than the outer fabric ply;

placing the interlining onto the thermoplastic resin coated surface of the first outer fabric;

folding the edges of the first outer fabric about the interlining without folding the edges of the interlining;

applying heat and pressure to effect bonding between the folded edges of the fabric and the interlining to form a creased fabric and interlining intermediate;

folding the edges of another outer fabric ply coated with resin having the same shape and dimension as the first outer fabric and applying heat to effect bonding between the folded edges and the fabric to form a creased fabric intermediate;

placing the creased fabric and interlining intermediate and creased fabric intermediate in alignment with the inner surfaces facing each other; and securing the intermediates to each other by stitching along the folded edges to provide a seam.

11. A method of fabricating a multi-ply garment component, comprising:

obtaining a first outer fabric ply having a shape corresponding to the garment component and a dimension larger than the garment component;

coating and fixing a thermoplastic resin on one surface thereof;

obtaining a cut fabric interlining having a dimension substantially corresponding in shape and size to the component and smaller than the first outer fabric ply;

placing the interlining onto the thermoplastic resin coated surface of the first outer fabric;

folding the edges of the first outer fabric about the interlining without folding the edges of the interlining;

applying heat and pressure to effect bonding between the folded edges of the fabric and the interlining to form a creased fabric and interlining intermediate;

placing two creased fabric and interlining intermediates in alignment with the inner surfaces facing each other; and securing the intermediates to each other by stitching along the folded edges to provide a seam.

12. A shirt neckband comprising:

a first fabric/interlining intermediate formed of a first outer fabric ply having a dimension larger than the neckband with a heat-fusible resin deposited on the inner surface thereof and a cut fabric interlining having a dimension corresponding substantially to the neckband and smaller than the outer fabric ply, the interlining placed onto the outer fabric ply with the edges of the outer fabric ply extending beyond the interlining, the edges of the outer fabric ply folded about the interlining and fused along the folded edges of the outer fabric ply by application of heat and pressure;

a complimentary creased outer fabric ply corresponding in dimension to the first outer fabric ply formed with a heat-fusible resin deposited on the inner surface thereof and the edges folded over and maintained in the folded condition in the dimension of the neckband by fusing of the resin due to the application of heat and pressure; and the first outer fabric/interlining neckband intermediate and complimentary neckband fabric ply placed in alignment with the inner surfaces facing each other and stitched along the creased edges when forming a shirt.

13. The neckband of claim 12, wherein the heat fusible resin is a polyvinyl acetate resin modified to be removed from the fabric under laundering conditions.

14. A method of fabricating a shirt neckband, comprising:

obtaining a first outer fabric ply having a shape corresponding to a neckband in a dimension larger than the finished neckband;

depositing a thermoplastic resin on one surface of the first outer fabric ply;

obtaining a cut fabric interlining having a dimension substantially corresponding in shape and size to the finished neckband and smaller than the first outer fabric ply;

placing the interlining onto the thermoplastic resin coated surface of the first outer fabric ply;

folding the edges of the first outer fabric ply about the interlining without folding the edges of the interlining;

applying heat and pressure to effect bonding between the folded edges of the fabric and the interlining to form a neckband-interlining intermediate;

folding the edges of another first outer fabric ply coated with resin having the same shape and dimension as the first outer fabric ply and applying heat to effect the bonding between the folded edges of the fabric to form a creased neckband intermediate;

placing the first neckband-interlining intermediate and creased fabric intermediate in alignment with the inner surfaces facing each other;

interposing the unsewn edge of a shirt collar between the aligned intermediates; and securing the intermediates to the collar and each other by stitching along the folded edges to provide a seam between the neckband and collar.

15. A method of fabricating a multi-ply shirt neckband, comprising:

obtaining first outer fabric plies having a shape corresponding to the neckband in a dimension larger than the finished neckband;

depositing a thermoplastic resin on one surface of the outer fabric plies;

obtaining cut fabric interlinings having a dimension substantially corresponding in shape and size to the finished neckband and smaller than the first outer fabric ply;

placing the interlinings onto the thermoplastic resin coated surfaces of the first outer fabric plies;

folding the edges of the first outer fabric plies about the interlinings without folding the edges of the interlining;

applying heat and pressure to effect bonding between the folded edges of the outer fabric plies and the interlinings to form neckbank interlining intermediates;

placing two neckband-interlining intermediates in alignment with the inner surfaces facing each other;

interposing the unsewn edge of a shirt collar between the aligned intermediates and stitching along the folded edges of the neckband to form a seam between the neckband and collar.

* * * * *